US010436526B2

(12) United States Patent
Bronner et al.

(10) Patent No.: US 10,436,526 B2
(45) Date of Patent: Oct. 8, 2019

(54) HEAT EXCHANGER WITH A CIRCUMFERENTIAL SEAL

(71) Applicant: Mahle Behr GmbH & Co. KG, Stuttgart (DE)

(72) Inventors: Harald Bronner, Bad Liebenzell (DE); Markus Gutjahr, Ederdingen (DE); Markus Huebsch, Markgroeningen (DE); Claus Augenstein, Gerlingen (DE); Reinhard Kull, Ludwigsburg (DE); Stefan Weise, Stuttgart (DE); Jens Ruckwied, Stuttgart (DE); Jochen Haeussermann, Oberstenfeld (DE)

(73) Assignee: Mahle Behr GmbH & Co. KG (DE)

( * ) Notice: Subject to any disclaimer, the term of this patent is extended or adjusted under 35 U.S.C. 154(b) by 465 days.

(21) Appl. No.: 15/107,457

(22) PCT Filed: Dec. 2, 2014

(86) PCT No.: PCT/EP2014/076262
§ 371 (c)(1),
(2) Date: Jun. 22, 2016

(87) PCT Pub. No.: WO2015/096956
PCT Pub. Date: Jul. 2, 2015

(65) Prior Publication Data

US 2016/0320148 A1 Nov. 3, 2016

(30) Foreign Application Priority Data

Dec. 23, 2013 (DE) ..... 10 2013 227 113

(51) Int. Cl.
*F28F 9/02* (2006.01)
*F28F 1/02* (2006.01)

(52) U.S. Cl.
CPC ..... *F28F 9/0226* (2013.01); *F28F 1/02* (2013.01); *F28F 2230/00* (2013.01); *F28F 2265/16* (2013.01); *F28F 2275/12* (2013.01)

(58) Field of Classification Search
CPC ..... F28F 9/0226; F28F 1/02; F28F 2230/00; F28F 2265/16; F28F 2275/12
See application file for complete search history.

(56) References Cited

U.S. PATENT DOCUMENTS 5,664,625 A * 9/1997 Letrange ..... F28F 9/02 165/149
8,074,708 B2 * 12/2011 Sugito ..... F28D 1/05366 165/173

(Continued)

FOREIGN PATENT DOCUMENTS

DE 112008002905 T5 12/2010
DE 102010033850 A1 2/2012

(Continued)

OTHER PUBLICATIONS

English abstract for DE-102010033850.
English abstract for FR-2822532.
English abstract for EP-2498040.

*Primary Examiner* — Jon T. Schermerhorn, Jr.
(74) *Attorney, Agent, or Firm* — Fishman Stewart PLLC

(57) ABSTRACT

A heat exchanger may include a plate, a seal and a cover. The plate may have at least two receiving grooves having a respective groove base, an intermediate region disposed in a plane between a plurality of rim holes, and a ramp extending between the intermediate region and the respective groove base of the at least two receiving grooves. The seal extends in the at least two receiving grooves. The ramp may be rounded at a transition to the receiving grooves with a first radius and at a transition to the intermediate region with a second radius, and the ramp may be inclined between (Continued)

$20° < \alpha < 65°$ relative to the intermediate region or has an S-shaped progression. An inflection point of the plate may be arranged in a region from 10% to 80% of a height difference between the intermediate region and the respective groove base.

19 Claims, 4 Drawing Sheets

(56) References Cited

U.S. PATENT DOCUMENTS

| | | | | |
|---|---|---|---|---|
| 8,910,704 | B2 | 12/2014 | Mizuno et al. | |
| 10,094,627 | B2 * | 10/2018 | Heine | F28F 9/0226 |
| 2009/0255657 | A1 | 10/2009 | Hakamata et al. | |
| 2010/0282449 | A1 | 11/2010 | Merklein et al. | |
| 2015/0168080 | A1 * | 6/2015 | Honma | F28F 9/0224<br>165/157 |

FOREIGN PATENT DOCUMENTS

| | | | |
|---|---|---|---|
| DE | 102012204520 | A1 | 10/2012 |
| EP | 1895260 | A2 | 3/2008 |
| EP | 2434245 | A1 | 3/2012 |
| EP | 2498040 | A2 | 9/2012 |
| FR | 2822532 | A1 | 9/2002 |
| WO | WO-2012/159971 | A1 | 11/2012 |
| WO | WO-2013/007758 | A1 | 1/2013 |

* cited by examiner

HEAT EXCHANGER WITH A CIRCUMFERENTIAL SEAL

CROSS-REFERENCE TO RELATED APPLICATIONS

This application claims priority to German Patent Application No. 10 2013 227 113.1, filed Dec. 23, 2013, and International Patent Application No. PCT/EP2014/076262, filed Dec. 2, 2014, both of which are hereby incorporated by reference in their entirety.

TECHNICAL FIELD

The present invention relates to a heat exchanger having a plate, a seal and a cover.

BACKGROUND

The connection of a cover to a plate (tube plate) of a heat exchanger requires a reliable seal between the two stated elements in order to prevent an escape of coolant and thus a possible failure of the heat exchanger or of an assembly to be cooled thereby. A plate of said type of a heat exchanger of said type is often, as a tube plate, equipped with corresponding rim holes through which, for example, there are pulled flat tubes. Said cover may for example be in the form of a coolant box and thus contain coolant. Normally, a reliable sealing action between the cover and the plate is realized by way of a seal which is inserted into a corresponding receiving groove of the plate. Here, the receiving groove is in fact composed of two parallel receiving grooves which are arranged, orthogonally with respect to the rim holes in the plate, at the edge of the plate and which are jointly produced during the punching and/or deformation of the plate. The seal runs between the two receiving grooves, orthogonally with respect thereto, specifically normally likewise at the edge of the plate, in a groove formed especially for the purpose.

To be able to form such encircling receiving grooves or grooves into the tube plate between the rim holes, one punching tool for one plate size is required, or a relatively cumbersome family tool is required, in particular if it is the intention for the tube plates to have different lengths.

EP 2 498 040 A2 has disclosed a heat exchanger which, for the precise sealing of the plate with the cover, does not provide an encircling groove in the edge region of the plate, into which groove a seal in the form of an encircling sealing ring is to be placed and onto which seal the cover is then placed or pressed. Rather, in the known heat exchanger, use may now be made of a plate which can be manufactured as material sold by the meter and which is cut to length correspondingly to the heat exchanger to be produced. For this purpose, the encircling sealing element or the encircling seal is placed into two opposite receiving grooves and is additionally, at ends of said receiving grooves, led over a surface of the plate between two rim holes.

FR 2 822 532 B1 discloses a further heat exchanger.

SUMMARY

The present invention is concerned with the problem of specifying, for a heat exchanger of the generic type, an alternative embodiment which permits, in particular, simplified production.

Said problem is solved according to the invention by way of the subject matter of the independent claim(s). The dependent claims relate to advantageous embodiments.

The present invention is based on the general concept of providing a heat exchanger, the plate (tube plate) of which is to be produced as material sold by the meter and which can therefore be used in a relatively flexible manner for heat exchangers of different sizes. Here, the heat exchanger according to the invention comprises a plate, a seal and a cover, wherein the plate, normally also referred to as tube plate, has two receiving grooves which are spaced apart in parallel and extend in a longitudinal direction of the plate and are arranged on two mutually opposite sides of the plate and are designed to receive lateral projections of the cover. Each of said receiving grooves furthermore has a groove base. The plate has at least three rim holes, that is to say openings for flat tubes, which are arranged in a plane so as to be spaced apart from one another in parallel and so as to be spaced apart from the receiving grooves and extend perpendicular to and between the receiving grooves. Between two such rim holes, in a plane, there is formed an intermediate region which is arranged so as to be spaced apart from the groove bases of the receiving grooves in parallel by a height difference h. Here, between each intermediate region and the groove bases, parallel to the longitudinal direction of the rim holes, there runs in each case one ramp, wherein the ramps are spaced apart from one another in parallel. The seal itself is in the form of an encircling sealing cord. According to the invention, it is now the case that the seal runs in the receiving grooves and with in each case one seal web over two ramps and an interposed intermediate region, wherein the ramps are inclined relative to the plane of the intermediate region, that is to say commonly relative to the horizontal, by an angle of $20° < \alpha < 65°$, or have an S-shaped profile, wherein an inflection point W is arranged in the region of 10% to 80% of the height difference h proceeding from the groove base of the receiving groove. Furthermore, in both variants, the ramps are rounded with a corresponding radius R1, R2 at the transition to the receiving groove or at the transition to the intermediate region respectively, in order in particular to minimize tensile and compressive stress peaks on the seal arising as a result of sharp bending of said seal. Here, the ramp is rounded with a radius R1 at the transition to the receiving groove, whereas said ramp is rounded with a radius R2 at the transition to the intermediate region.

With the design according to the invention of the plate, it can be achieved that the seal, in the installed state, is clamped between the plate and cover without excessively intense contact pressure or deformation. With the heat exchanger according to the invention, therefore, it is firstly the case that an endless metal sheet in the form of a plate can be used, and secondly, the contact pressure or the deformation of the installed seal does not exceed or fall below critical limit values. Through the selection of the angle $\alpha$ between 20° and 65°, the sealing action and the load on the seal can be additionally influenced. An angle of $\alpha < 20°$ would specifically yield firstly disadvantages for the subsequent deformation process of the rim hole and secondly disadvantages with regard to the lateral guidance of the seal along the receiving groove. In the case of an angle of $\alpha > 65°$, the pressing force exerted on the seal is under some circumstances too low, whereby, under some circumstances, it would not be possible for the sealing action to be ensured. Also, in the variant with S-shaped profile, it is possible to achieve improved abutment of the seal against the plate, and thus an improved sealing function. Below or above the stated range, it would specifically be the case that radii R1 and R2 would arise which would either have a disadvantageous effect on the subsequent deformation process of the rim hole or would have an adverse effect on the width of the plate and thus also on the required structural space. If the inflection point W is situated in the region of <10% of the height difference h, this yields a profile of the S-shaped ramp which either has a disadvantageous effect on the plate width and thus on the structural space or has a disadvantageous effect with regard to the stress peaks on the seal. If the inflection point W is situated in the region of >80% of the height difference h, this yields a profile of the S-shaped ramp which has a disadvantageous effect on the subsequent deformation process.

It is expediently the case that a ratio of the radius R1 or R2 to a radius R3 of the section of the sealing cord or seal in the receiving groove in the non-compressed state amounts to $0.3<R1/R3<3.0$ or $0.3<R2/R3<3.0$. The specification of this range of the ratio between a bend radius of the ramp and radius of the seal optimizes the sealing action. Specifically, too low a ratio would give rise to a leak owing to too low a contact pressure at the transition region between receiving groove and ramp, wherein an excessively high ratio would give rise to too low a pressing force along the ramp and a structural space disadvantage owing to a wider plate.

It is expediently the case that a longitudinal end, facing toward the receiving groove, of a rim hole lies between 1 mm<a<15 mm, in particular between 2 mm<a<6 mm, closer to the receiving groove than a transition of the ramp to the intermediate region. By way of this range, determined by way of tests and calculations, it is possible for the maximum mechanical stress to be accommodated in the radius region of the respective rim hole to be reduced, and thus for the stress loading of the plate as a whole to be reduced.

In a further advantageous embodiment of the solution according to the invention, at least one of the ramps is in the form of a groove which extends parallel to the longitudinal direction of the rim holes and in which the seal runs in sections, wherein the ratio of the degree of groove filling by the seal in the groove and in the at least one ramp to the degree of groove filling by the seal in the receiving groove in the compressed state of the seal amounts to between 1.0 and 1.4. Here, the degree of groove filling is defined as the ratio between the cross section of the compressed seal and the free cross-sectional area. Normally, in the design of seals, a degree of groove filling of between 70 and 85% is predefined in order, firstly, to ensure the sealing action and, secondly, provide a reserve volume for possible swelling of the seal. By way of the ratio specified above, it can be achieved that the seal can be guided and fixed in optimum fashion and, at the same time, more intense compression can be achieved in the ramp region, which improves the sealing function. Specifically, the compression should be more intense in the region of the ramp than along the receiving groove in order to be able to ensure an optimum sealing action.

It is expediently the case that the ramps have a width b1 and the intermediate regions have a width b2, wherein the ratio b1 to b2 lies between 0.3 and 1.0. To achieve optimum compression of the seal in the groove of the intermediate region and in the receiving groove, the degree of groove filling should be between 70 and 100% at both locations. Since, however, the pressing force of the seal in the receiving groove and against the ramps varies, it is necessary for the desired degree of groove filling of between 70 and 100% to be achieved by way of structural designs. Purely theoretically, this may be realized by way of variations of the diameter of the seal along the ramp, in particular at the transition region, or else by variation of the free cross-sectional area along the ramp at the transition region. By way of the variation of the widths of the ramps or of the intermediate regions, the desired degree of groove filling can be achieved in a particularly simple manner in terms of construction. It is particularly advantageous if the cross section of the seal amounts to >40%, in particular between 50% and 70%, of the cross section of the non-compressed seal along the receiving groove.

In a further advantageous embodiment of the solution according to the invention, the seal has at least one preload web for reducing tensile stresses on the seal, wherein the at least one preload web is arranged parallel to a seal web. The seal web of the seal in this case runs over two ramps and over an interposed intermediate region outside the preload web that runs parallel thereto. Preload webs may generally be constituent parts of the seal and ensure that said seal is under preload along the receiving grooves, whereby tensile stress on the seal in the region of the transition between the rim holes can be reduced. In this way, it is possible to ensure the desired position of the seal both along the receiving groove and between the rim holes.

The cover is expediently in the form of a box which has lateral projections running along the longitudinal side on the outer region of the box at two mutually opposite sides, wherein the lateral projections extend in the receiving grooves and have a protrusion which projects longitudinally beyond the seal.

The cover is advantageously in the form of a box which has a box foot, wherein, on a longitudinal side on the outer region of the box foot, there is arranged a projection for the positioning of the box on the plate.

A projection for the positioning of the box on the plate may be arranged on the outer region of the lateral projection. The lateral projection is for example the box foot. Owing to the position of the seal between the rim holes in the region of a narrow side, it is advantageous, for the compression of the seal, for the connection between the plate and the cover or box to extend along the receiving groove at least as far as the point at which the seal bends out of the receiving groove, over the ramp and into the intermediate region. Here, it is particularly advantageous if the lateral projection has, along the receiving groove, a protrusion, giving rise to an H-shaped design. The H shape is in this case realized by way of the two protrusions of the lateral projection on both sides in combination with the web of the lateral projection between the rim holes. Here, the protrusions of the lateral projection may either terminate flush with or project beyond the receiving groove.

In a further advantageous embodiment of the solution according to the invention, the heat exchanger has a side part, which is inserted through a rim hole of the plate, with a side part protrusion s for the closure of the plate by way of the cover, wherein the average spacing between the side part and an adjacent, outer flat tube has the value q, and wherein the ratio s divided by q amounts to between 0.3 and 0.7. Such an embodiment ensures that an optimum sealing action in the region of the seal web, that is to say of the intermediate region, with simultaneously minimal structural space can be ensured. Purely theoretically, the ratio s divided by q may also assume a value greater than 0.7, in particular if, in the case of thermally highly loaded heat exchangers, partial or complete blocking of the outer tube is desired. In this case, the cover geometry should be designed such that the outer wall of the cover entirely prevents or at least reduces a flow through the outer tube or through several of the outer tubes. Likewise, the cover geometry may also be selected such that one or more guide elements restricts or entirely prevents the flow to the one or more outermost tubes (flat tubes).

In a further advantageous embodiment, all of the rim holes have the same contour and the same area. This permits simple production of the plate from an endless metal sheet.

It may furthermore be advantageous for at least the two outer rim holes arranged on the lateral ends of the plate to have an area which differs from the otherwise identical area of the other rim holes by a factor of 0.8 to 1.3. In this way, side parts with different wall thicknesses can be used, whereby the strength of the component can be increased.

Further important features and advantages of the invention will emerge from the subclaims, from the drawings and from the associated description of the figures on the basis of the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein the same reference signs are used to denote identical or similar or functionally identical components.

BRIEF DESCRIPTION OF THE DRAWINGS

In the drawings, in each case schematically.

DETAILED DESCRIPTION

Figure 1:
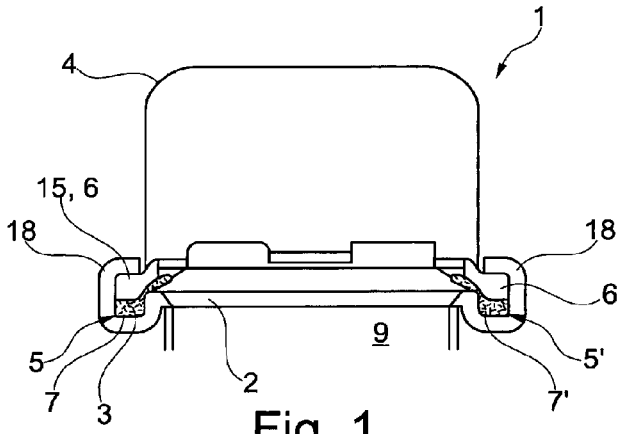
FIG. 1 is a sectional illustration through a heat exchanger having a cover, a plate and a seal according to the prior art.
Figure 2:
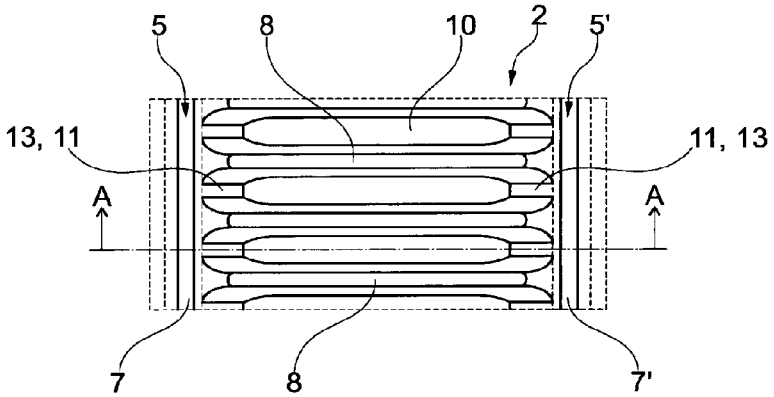
FIG. 2 shows a view from above of a plate according to the invention.
Figure 3:
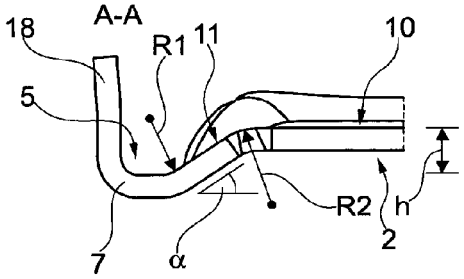
FIG. 3 is a sectional illustration, in the section plane A-A, through the plate as per FIG. 2 in the region of a receiving groove, a ramp and an intermediate region.
Figure 5:
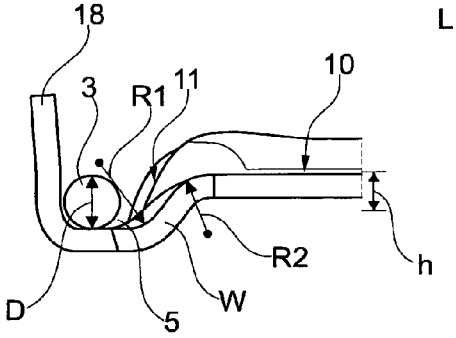
FIG. 5 is an illustration as in FIG. 3, but in the case of a ramp of S-shaped form.
Figure 11:
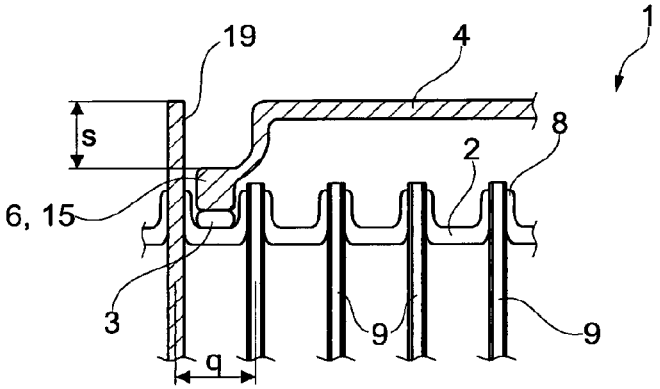
FIG. 11 is a sectional illustration through the heat exchanger according to the invention for the purposes of illustrating the protrusion s of a side wall and the spacings of the individual flat tubes to one another and of an outer flat tube to the side wall.

Correspondingly to FIGS. 1 and 11, a heat exchanger 1 has a plate 2, a seal 3 and a cover 4. Here, FIG. 1 shows a heat exchanger 1 according to the prior art, whereas FIG. 11 illustrates a heat exchanger 1 according to the invention. Considering the plate 2, it can be seen that said plate has two parallel receiving grooves 5, 5' which are spaced apart from one another in parallel and extend in a longitudinal direction of the plate 2 and are arranged on two mutually opposite sides of the plate 2 and are designed to receive lateral projections 6, that is to say the box foot 15, of the cover 4. Here, each of the receiving grooves 5, 5' has a groove base 7, 7'. Furthermore, the plate 2 has at least three rim holes 8, which are arranged in a plane so as to be spaced apart from one another in parallel and so as to be spaced apart from the receiving grooves 5, 5' and extend perpendicular to and between the receiving grooves 5, 5' (cf. in particular also FIGS. 2, 7, 9 and 11). Flat tubes 9 are led sealingly through the rim holes 8, wherein in each case one side part 19 is inserted through the two outer rim holes. In the plane, between two rim holes 8, there is formed an intermediate region 10 which is arranged so as to be spaced apart from the groove bases 7, 7' of the receiving grooves 5, 5' in parallel by a height difference h (cf. FIGS. 3 and 5). Furthermore, between each intermediate region 10 and the groove bases 7, 7', parallel to the longitudinal direction of the rim holes 8, there runs in each case one ramp 11, wherein the ramps 11 of adjacent intermediate regions 10 are spaced apart from one another in parallel. The seal 3 is in the form of an encircling sealing cord.

Figure 4:
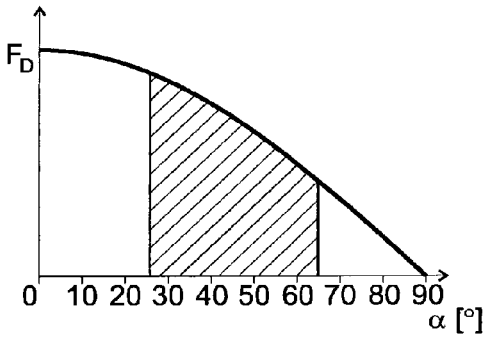
FIG. 4 shows a diagram illustrating the pressing force FD of the seal as a function of the angle $\alpha$ of the ramp.

According to the invention, the seal 3 now runs in the receiving grooves 5, 5' and with in each case one seal web 12 (cf. FIG. 10) over two ramps 11 and the interposed intermediate region 10, wherein, according to the invention, the ramps 11 are inclined relative to the intermediate region 10, and commonly also relative to the horizontal, by an angle $\alpha$ of between 20 and 65° (cf. FIG. 3) or have an S-shaped profile (cf. FIG. 5), wherein an inflection point W is arranged in the region of 10% to 80% of the height difference h proceeding from the groove base 7, 7' of the receiving groove 5, 5'. Here, in FIG. 3, the plate 2 has been cut away in order to illustrate the radius R2, but self-evidently does not have an opening in said region. Each of the ramps 11 is in this case rounded with a radius R1 at the transition to the receiving groove 5, 5' and with a radius R2 at the transition to the intermediate region 10. The radii R1 and R2 may self-evidently be different sizes, wherein larger radii assist in reducing the stress peaks acting on the seal 3. By way of an angle $\alpha$ of less than 20°, it is possible for disadvantages firstly in the subsequent process of deformation of the rim hole 8, and secondly in the lateral guidance of the seal 3 along the receiving groove 5, 5', to be reduced. In the case of an angle of $\alpha$ greater than 65°, the pressing force FD exerted on the seal 3 by the cover 4 would be too low, as illustrated by FIG. 4. In the angle range $20° < \alpha < 65°$ established by way of tests, an optimum pressing force FD can be achieved, by way of which the desired sealing action can be ensured. The stated height range of the inflection point W between 10 and 80% of the height difference h would yield radii R1 and R2 which are particularly expedient for the abutment of the seal 3 against the plate 2. Below and above said stated range, radii R1 and R2 have been obtained which would have an adverse effect on the width of the plate 2 and thus on the structural space requirement. It is furthermore particularly advantageous that the plate 2 according to the invention can now be produced as an endless metal sheet, and it is thus possible for heat exchangers 1 of a wide variety of sizes to be produced in a highly flexible manner.

In an advantageous refinement of the solution according to the invention, a ratio of the height difference h to the diameter D of a section of the seal 3 in the receiving groove 5, 5' in the non-compressed state amounts to $0.7<h/D<2.5$, preferably $1.0<h/D<2.0$. By way of the ratio of h to D selected in said range, a strength advantage can be achieved by way of the resulting plate geometry.

Figure 6:
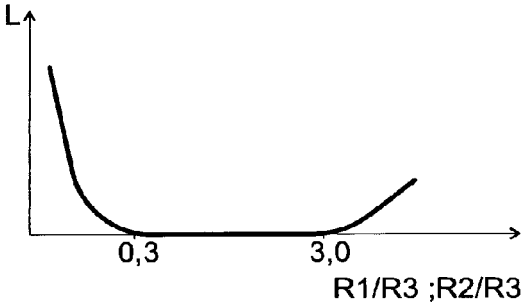
FIG. 6 shows a diagram illustrating possible leakage L as a function of a radius R1 or R2 at the transition of the ramp to the receiving groove or to the intermediate region relative to the radius R3 of the seal.
Figure 7:
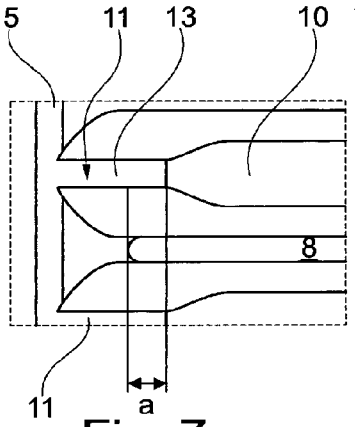
FIG. 7 shows a view from above of the plate according to the invention for the purposes of illustrating a spacing a between a longitudinal end of a rim hole and the transition of the ramp to the intermediate region.

It is likewise advantageous if a ratio of the radius R1 or R2 to a radius R3 of the section of the seal 3 in the receiving groove 5, 5' in the compressed state amounts to $0.3<R1/R3<3.0$ or $0.3<R2/R3<3.0$. A lower ratio could, under some circumstances, lead to a leak owing to too low a contact pressure at the transition region between the receiving groove 5, 5' and the ramp 11. If the ratio is too high, this results in too low a pressing force along the ramp 11 and/or in a structural space disadvantage, because a wider plate 2 is required. Here, in FIG. 6, the leak (leakage L) is illustrated as a function of the stated radii ratio, wherein it can be clearly seen that, in the case of a radii ratio R1/R3 or R2/R3 of between 0.3 and 3.0, the leakage, that is to say the leak, is at its smallest.

Figure 8:
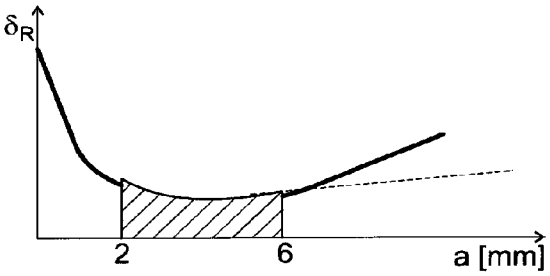
FIG. 8 shows a diagram illustrating the dependence of the tube stress $\sigma_R$ on the spacing a, FIG. 9 shows a view from above of the plate according to the invention for the purposes of illustrating the width b1 of the ramp and the width b2 of the intermediate region.

Furthermore, in order to be able to keep the mechanical stresses $\sigma_R$ in the flat tube 9 as low as possible, a longitudinal end, facing toward the receiving groove 5, 5', of a rim hole 8 lies between 1 mm<a<15 mm, in particular between 2 mm<a<6 mm, closer to the receiving groove 5, 5' than a transition of the ramp 11 to the intermediate region 10. The meaning of the spacing a is in this case illustrated in FIG. 7, wherein a dependency of the tube stress σR on the spacing a is indicated in the diagram in FIG. 8. It can be clearly seen here that the tube stress σR can be minimized in the case of a value a of between 2 and 6 mm.

At least one of the ramps 11 may furthermore be formed as a groove 13 which extends parallel to the longitudinal direction of the rim holes 8 and in which the seal 3 runs in sections, wherein the ratio of the degree of groove filling by the seal 3 in the groove 13 to the degree of groove filling by the seal 3 in the receiving groove 5, 5' in the compressed state of the seal 3 should amount to between 1.0 and 1.4. If the ratio lies in the stated range, the seal 3 can, on the one hand, be optimally guided and fixed, and secondly, an optimum sealing function can be achieved by way of more intense compression in the ramp region 11 and/or in the transition region of the ramp 11 to the receiving groove 5, 5' and/or to the intermediate region 10.

Figure 9:
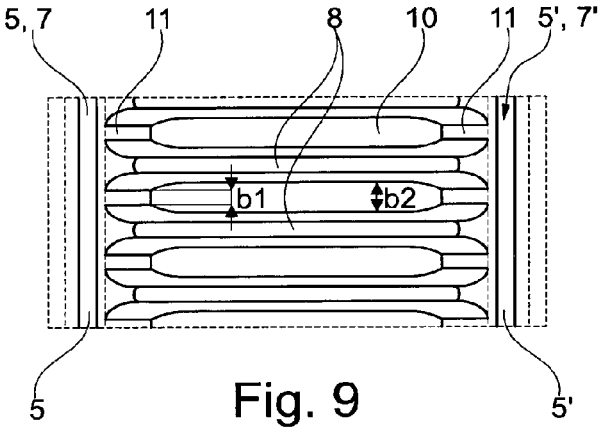

Considering FIG. 9, it can be seen that the ramps 11 have a width b1 and the intermediate regions 10 have a width b2, wherein the ratio of the width b1 to b2 should amount to between 0.3 and 1.0. Furthermore, the cross section of the seal 3 in the region of the ramp 11 should amount to >40% of the cross section of the seal 3 in the region of the receiving groove 5, 5', preferably between 50% and 70%. In this way, an optimum degree of groove filling can be achieved by way of simple structural means.

Figure 10:
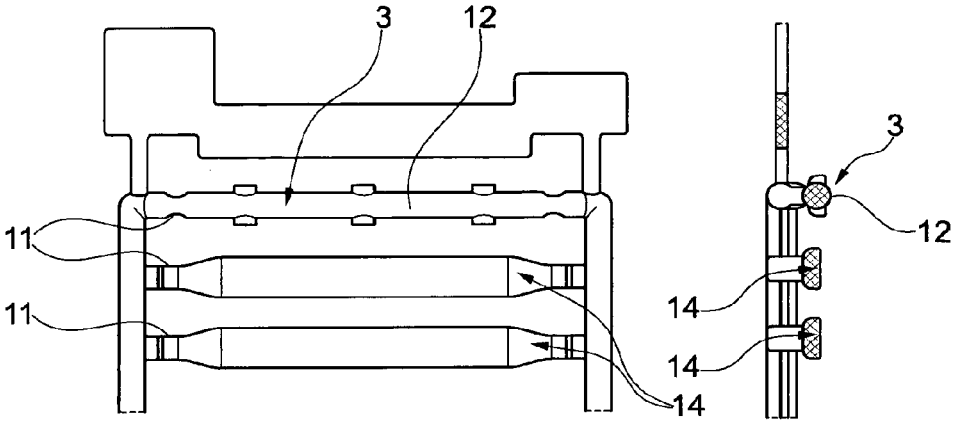
FIG. 10 shows a view from above, and a sectional illustration, of the seal belonging to the plate according to the invention, for the purposes of illustrating the profile of the seal with seal web and preload webs.

Considering FIG. 10, it can be seen that the seal 3 has, in addition to the seal web 12 itself, at least one further preload web 14 which runs parallel to the seal web 12 and which effects a reduction of tensile stress on the seal 3. In this way, it is possible for the desired optimum position required for the sealing action to be ensured both along the receiving groove 5, 5' and between the rim holes 8.

Figure 13:
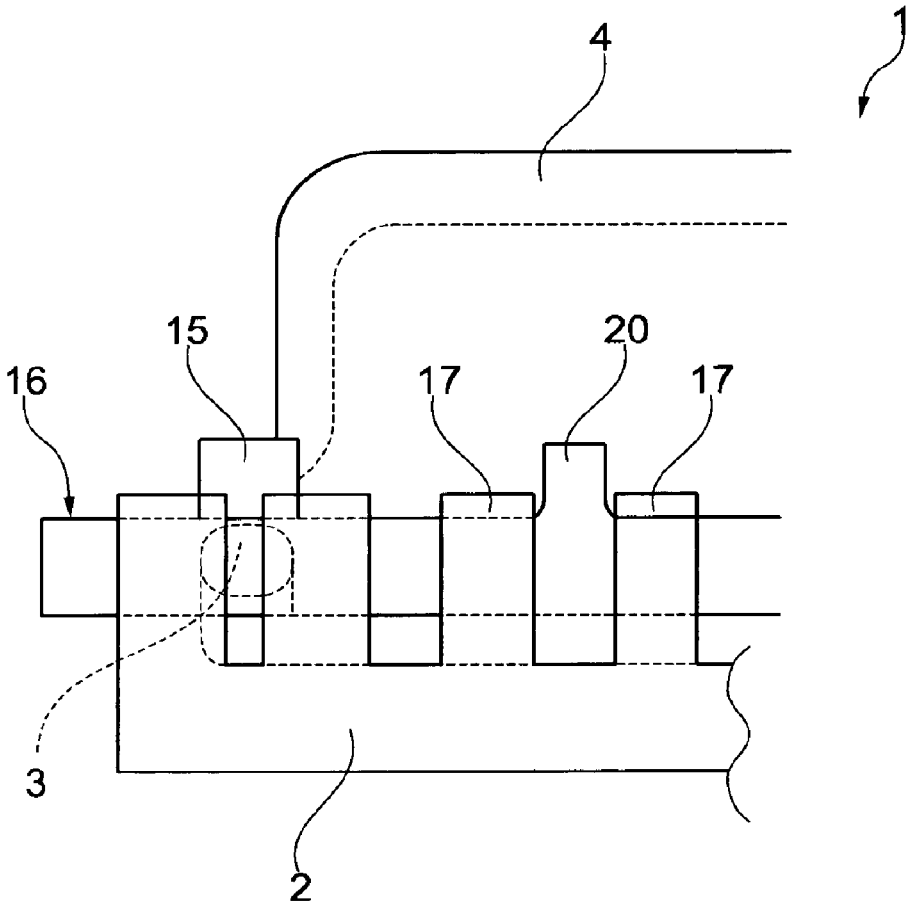
FIG. 13 is a sectional illustration through the heat exchanger according to the invention with lateral protrusion for the fixing of the cover to the plate.

Considering FIG. 13, it is shown in said Figure that the cover 4 has lateral projections 6, or box feet 15, running along the longitudinal side at two mutually opposite sides, wherein, in the situation shown, only one of the two sides is illustrated, and wherein the lateral projections 6 extend in the receiving grooves 5, 5' and have a protrusion 16 which projects longitudinally beyond the respective receiving groove 5, 5'. The protrusion 16 is intended to project beyond the region at which the seal 3 bends. Here, said seal may also project beyond the receiving groove 5, 5' or else terminate flush therewith. Owing to the position of the seal 3 between the rim holes 8 in the region of a narrow side, it is advantageous, for the sealing compression of the seal 3, if the connection between the plate 2 and the cover 4 extends along the receiving groove 5, 5' at least to the point where the seal 3 is led between the rim holes 8, particularly advantageous if the box foot 15 projects along the receiving groove 5, 5' beyond the seal 3, wherein said box foot may form a flush termination of the respective receiving groove 5, 5' or has the protrusion 16 described above. In this case, too, the protrusion 16 should project beyond the region at which the seal 3 bends.

This gives rise to a H-shaped lateral projection design. FIG. 13 shows such a connection of the cover 4 to the plate 2, wherein the profile of the seal 3 and the position of an outer closure 17, which extends, through the likewise illustrated protrusion 16 on the box foot 15, beyond the profile of the seal 3 between the rim holes 8 are shown. In this way, an improved sealing function is possible in particular by way of a greater pressing action.

It may also be provided that, on the box foot 15, there is arranged a projection 20 for the positioning of the cover 4 on the plate 2. A projection 20 of said type serves for the optimum positioning of the cover 4 relative to the plate 2 in a longitudinal direction, and furthermore makes it possible for the tolerances of the tolerance chain in the longitudinal direction to be halved.

Figure 12:
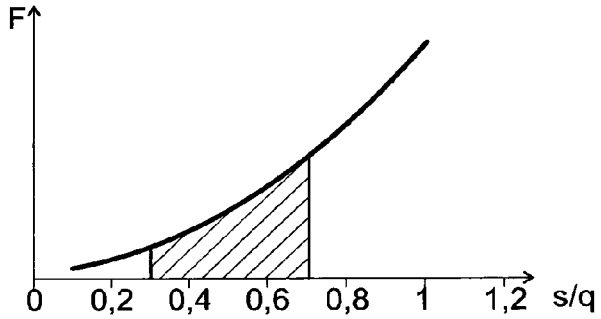
FIG. 12 shows a diagram for illustrating the strength of the flanged connection realized by way of the bent-over protrusion s, as a function of a ratio s/q.

The receiving groove 5, 5' may furthermore have a wall 18 which, for the connection of the cover 4 to the plate 2, is at least partially bent, specifically in such a way that it engages behind a part of the box foot 15 of the cover 4. The wall 18 of the receiving groove 5, 5' may have multiple regions and/or crenellations which repeat in terms of their geometrical shape and which are arranged symmetrically with respect to the rim holes 8 of the plate 2 and which can be or are bent around the box foot 15 of the cover 4 (cf. FIG. 1). Furthermore, the heat exchanger 1 has a side part 19 with a side part protrusion s for the connection of the plate 2 to the cover 4, wherein the average spacing between the side part 19 and an adjacent, outer flat tube 9 has the value q, and wherein the ratio s/q should amount to between 0.3 and 0.7 (cf. FIGS. 11 and 12). Here, in FIG. 11, a combination with a side part protrusion s is shown, wherein the ratio s/q is in this case 0.7. In the case of a ratio s/q=0.3, a smaller contact surface against the lateral projection 6 or box foot 15 is realized. The side part protrusion s should therefore be selected such that, on the one hand, the pressing force required for the sealed connection between the plate 2 and the cover 4 can be achieved, but the cover 4 does not impede a flow in the outermost flat tube 9. Here, FIG. 12 shows the strength of the closure and thus also indirectly the sealing action as a function of the ratio s/q.

All of the rim holes 8 of the plate 2 may have the same contour and the same area for tubes 9 and side parts 19, whereby the manufacturing process is simplified. It is also possible for the outer rim holes 8 to have, depending on the wall thickness of the side part 19, a smaller or larger area than the other rim holes 8.

Furthermore, the shape of the transition regions, in particular between the two outer rim holes 8, may differ from that of the other transition regions. For example, the ramp 11 may be implemented only between the outer three rim holes 8. The shape of the transition regions may also differ so as to yield a repeating pattern.

With the heat exchanger 1 according to the invention, and in particular with a plate 2 according to the invention, it is possible for a plate 2 of said type to be produced as an endless metal sheet and thus to be used in a highly flexible manner in heat exchangers 1 of different dimensions. At the same time, an optimum sealing action can be achieved.

The invention claimed is:

1. A heat exchanger comprising: a plate, a seal and a cover;

the plate including at least two receiving grooves that are spaced apart in parallel and extend in a longitudinal direction of the plate, the at least two receiving grooves arranged on two mutually opposite sides of the plate and configured to receive a lateral projection of the cover;

the at least two receiving grooves having a respective groove base;

wherein the plate has at least three rim holes arranged in a plane spaced apart from one another in parallel and spaced apart from the at least two receiving grooves, the at least three rim holes extending perpendicular to and between the at least two receiving grooves;

an intermediate region disposed in the plane between at least two rim holes of the at least three rim holes, wherein the intermediate region is arranged spaced apart from the respective groove base of the at least two receiving grooves in parallel by a height difference;

at least two ramps respectively disposed between the intermediate region and the respective groove bases, wherein the at least two ramps extend parallel to a longitudinal direction of the at least three rim holes and are spaced apart from one another in parallel;

wherein the seal includes an encircling sealing cord;

the seal extending in the at least two receiving grooves and via a seal web over a corresponding one of the at least two ramps and the intermediate region;

wherein the at least two ramps are rounded with a first radius at a transition to the at least two receiving grooves and with a second radius at a transition to the intermediate region; and wherein the at least two ramps have a curved profile with an inflection point arranged in a region of 10% to 80% of the height difference from the respective groove base of the at least two receiving grooves to the intermediate region.

2. The heat exchanger as claimed in claim 1, wherein a ratio of the height difference to a diameter of a section of the seal in the at least two receiving grooves in a non-compressed state of the seal is 0.7 to 2.5.

3. The heat exchanger as claimed in claim 2, wherein the ratio is between 1.0 and 2.0.

4. The heat exchanger as claimed in claim 1, wherein a ratio of the first radius to a third radius of a section of the seal in the at least two receiving grooves in a compressed state of the seal is 0.3 to 3.0.

5. The heat exchanger as claimed in claim 1, wherein at least one rim hole has a longitudinal end facing toward a respective one of the at least two receiving grooves that is disposed between 1 mm to 15 mm closer to the respective one of the at least two receiving grooves than a transition of at least one of the at least two ramps to the intermediate region.

6. The heat exchanger as claimed in claim 1, wherein at least one of the at least two ramps is configured as a groove that extends parallel to the longitudinal direction of the rim holes and the seal runs in sections in the groove, wherein a ratio of a degree of groove filling by the seal in the groove to a degree of groove filling by the seal in at least one of the at least two receiving grooves in a compressed state of the seal is between 1.0 and 1.4.

7. The heat exchanger as claimed in claim 1, wherein the at least two ramps have a first width and the intermediate region has a second width, and wherein a ratio of the first width to the second width is between 0.3 and 1.0.

8. The heat exchanger as claimed in claim 1, wherein the seal further includes at least one preload web for reducing tensile stresses on the seal, wherein the at least one preload web is arranged parallel to the seal web.

9. The heat exchanger as claimed in claim 1, wherein the cover is configured as a box and includes at least two lateral projections respectively running along a longitudinal side on an outer region of the box at two mutually opposite sides, wherein the at least two lateral projections extend in the at least two receiving grooves and have a protrusion projecting longitudinally beyond the seal.

10. The heat exchanger as claimed in claim 1, wherein the cover is configured as a box and includes a box foot, wherein the box foot has a projection arranged on a longitudinal side of an outer region of the box foot, there is arranged a projection (20) for positioning the box on the plate.

11. The heat exchanger as claimed in claim 1, wherein the at least two receiving grooves have a wall at least partially bent and configured to engage behind at least a part of the lateral projection of the cover.

12. The heat exchanger as claimed in claim 11, wherein the wall of the at least two receiving grooves includes a plurality of crenellations having a repetitive geometrical shape and arranged symmetrically with respect to the at least three rim holes of the plate, and wherein the plurality of crenellations are bendable around the lateral projection of the cover.

13. The heat exchanger as claimed in claim 1, further comprising a side part insertable through at least one of the at least three rim holes of the plate, wherein the side part includes a side part protrusion for connecting the plate to the cover, and wherein an average spacing between the side part and an adjacent, outer flat tube has a value, wherein a ratio of the side part protrusion to the value of the average spacing is between 0.3 and 0.7.

14. The heat exchanger as claimed in claim 1, wherein the at least three rim holes have an equal contour and an equal area.

15. The heat exchanger as claimed in claim 1, wherein at least two of the rim holes arranged at a respective lateral end of the plate have an area which differs from an area of another rim hole by a factor of 0.8 to 1.3.

16. The heat exchanger as claimed in claim 1, wherein a plurality of intermediate regions are arranged interposed between the at least three rim holes, and wherein at least two ramps are associated with each of the plurality of intermediate regions and extend between a corresponding one of the plurality of intermediate regions and the respective groove base of the at least two receiving grooves.

17. The heat exchanger as claimed in claim 1, wherein a ratio of the second radius to a third radius of a section of the seal in the at least two receiving grooves in a compressed state of the seal is 0.3 to 3.0.

18. A heat exchanger, comprising:

a cover including at least two projections;

a plate including at least two receiving grooves disposed spaced apart from one another in parallel and extending in a longitudinal direction of the plate, the at least two receiving grooves having a respective groove base; wherein the at least two receiving grooves are arranged on mutually opposite sides of the plate and are configured to receive a respective one of the at least two projections of the cover;

the plate further including a plurality of rim holes arranged in a plane spaced apart from one another in parallel and spaced apart from the at least two receiving grooves, wherein the plurality of rim holes extend perpendicular to and between the at least two receiving grooves;

the plate further including a plurality of intermediate regions respectively interposed between the plurality of rim holes, wherein the plurality of intermediate regions are arranged in the plane and spaced apart from the respective groove base of the at least two receiving grooves in parallel by a height difference;

at least two ramps associated with a corresponding one of the plurality of intermediate regions, wherein the at least two ramps extend between the corresponding one of the plurality of intermediate regions and the respective groove base of the at least two receiving grooves, and wherein the at least two ramps extend parallel to a longitudinal direction of the plurality of rim holes and are arranged spaced apart from one another in parallel;

a seal extending in the at least two receiving grooves, wherein the seal includes an encircling sealing cord and a seal web, wherein the seal web extends over at least one of the plurality of intermediate regions and the at least two ramps;

wherein the at least two ramps are rounded with a first radius at a transition to the at least two receiving grooves and with a second radius at a transition to the corresponding one of the plurality of intermediate regions, and wherein the at least two ramps have a curved profile with an inflection point arranged in a region of 10% to 80% of the height difference from the respective groove base of the at least two receiving grooves to the corresponding one of the plurality of intermediate regions.

19. The heat exchanger as claimed in claim 18, further comprising a side part insertable through at least one of the plurality of rim holes, wherein the side part includes a side part protrusion for connecting the plate to the cover, and wherein an average spacing between the side part and an adjacent outer flat tube has a value, and a ratio of the side part protrusion to the valve value of the average spacing is between 0.3 and 0.7.

* * * * *